US011952230B2

(12) United States Patent
Lin et al.

(10) Patent No.: US 11,952,230 B2
(45) Date of Patent: Apr. 9, 2024

(54) THICK DOCUMENT CONVEYING DEVICE

(71) Applicant: Foxlink Image Technology Co., Ltd., New Taipei (TW)

(72) Inventors: Wei Fong Lin, New Taipei (TW); Yuan Yi Lin, New Taipei (TW); Chih Yuan Yang, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 356 days.

(21) Appl. No.: 17/567,156

(22) Filed: Jan. 3, 2022

(65) Prior Publication Data

US 2023/0065272 A1 Mar. 2, 2023

(30) Foreign Application Priority Data

Aug. 25, 2021 (CN) ..... 202122021495.4

(51) Int. Cl.
*B65H 3/06* (2006.01)
*B65H 29/20* (2006.01)

(52) U.S. Cl.
CPC ..... *B65H 3/0615* (2013.01); *B65H 3/063* (2013.01); *B65H 3/0669* (2013.01); *B65H 3/0684* (2013.01); *B65H 29/20* (2013.01); *B65H 2402/60* (2013.01); *B65H 2403/41* (2013.01); *B65H 2403/46* (2013.01); *B65H 2403/73* (2013.01); *B65H 2405/40* (2013.01); *B65H 2511/13* (2013.01)

(58) Field of Classification Search
CPC .... B65H 3/0669; B65H 3/0684; B65H 3/063; B65H 2511/13
See application file for complete search history.

(56) References Cited

U.S. PATENT DOCUMENTS 5,244,197 A * 9/1993 Helmstadter ..... B65H 3/042 271/35
5,301,834 A * 4/1994 Lee ..... B65H 3/523 221/241
9,193,545 B1 * 11/2015 Hsieh ..... B65H 3/063
9,216,868 B1 * 12/2015 Li ..... B65H 3/063
11,220,407 B2 * 1/2022 Morikawa ..... B65H 3/5284

* cited by examiner

*Primary Examiner* — Patrick Cicchino
(74) *Attorney, Agent, or Firm* — Lin & Associates Intellectual Property, Inc.

(57) ABSTRACT

A thick document conveying device includes a paper pickup mechanism. The paper pickup mechanism has a pick roller base, a pick roller axle, a pick roller, a switching assembly, a first universal coupling, a driving mechanism, a second universal coupling, a bearing and a gear. The pick roller axle and the pick roller are located in the pick roller base. The switching assembly is located under the pick roller base. The first universal coupling is connected to the pick roller axle. The driving mechanism is sleeved on the first universal coupling. The second universal coupling is connected to the driving mechanism. The bearing is connected to the driving mechanism. The gear is connected to the bearing. As described above, both a thick document and a thin document can be adapted.

12 Claims, 9 Drawing Sheets

THICK DOCUMENT CONVEYING DEVICE

CROSS-REFERENCE TO RELATED APPLICATION

The present application is based on, and claims priority from, China Patent Application No. 202122021495.4, filed Aug. 25, 2021, the disclosure of which is hereby incorporated by reference herein in its entirety.

BACKGROUND OF THE INVENTION

1. Field of the Invention

The present invention generally relates to a thick document conveying device capable of conveying both thin document and thick document.

2. The Related Art

A conventional image forming apparatus particularly to a mini portable scanner merely can process a thin document, but is incapable of processing a thick document such as a thick identification (ID) card etc., because a height of a document channel of the image forming apparatus is designed for the thin document. In order to contiguously feed the thin document into the image forming apparatus, a height of a paper pickup roller at the document channel is fixed, so that the pick roller contiguously contacts with thin document during a paper pickup process. Such structure is incapable of feeding the the thick document into the document channel, conveying the thick document along the document channel and discharging the thick document from the document channel. Therefore, it is necessary to provide an innovative thick document conveying device used in an image forming apparatus, the image forming apparatus with the thick document conveying device has the capability of adjusting a height of the paper pickup mechanism in a conveying path for adapting to both the thin document and the thick document.

SUMMARY OF THE INVENTION

An object of the present invention is to provide a thick document conveying device. The thick document conveying device includes a paper pickup mechanism. The paper pickup mechanism has a pick roller base, a pick roller axle, a pick roller, a switching assembly, a first universal coupling, a driving mechanism, a second universal coupling, a bearing and a gear. The pick roller axle is located in the pick roller base. The pick roller is located in the pick roller base and is sleeved on the pick roller axle. The switching assembly is located under the pick roller base. One end of the first universal coupling is connected to the pick roller axle. The driving mechanism has a first driving mechanism and a second driving mechanism, one end of the first driving mechanism is sleeved on the other end of the first universal coupling. One end of the second universal coupling is connected to the other end of the first driving mechanism, one end of the second driving mechanism is sleeved on the other end of the second universal coupling. The bearing is connected to the other end of the second driving mechanism. The gear is connected to the bearing. In moved up status or moved down status, the pick roller base is drove by the switching assembly to move in a vertical direction.

As described above, both the thick document and the thin document can be adapted.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
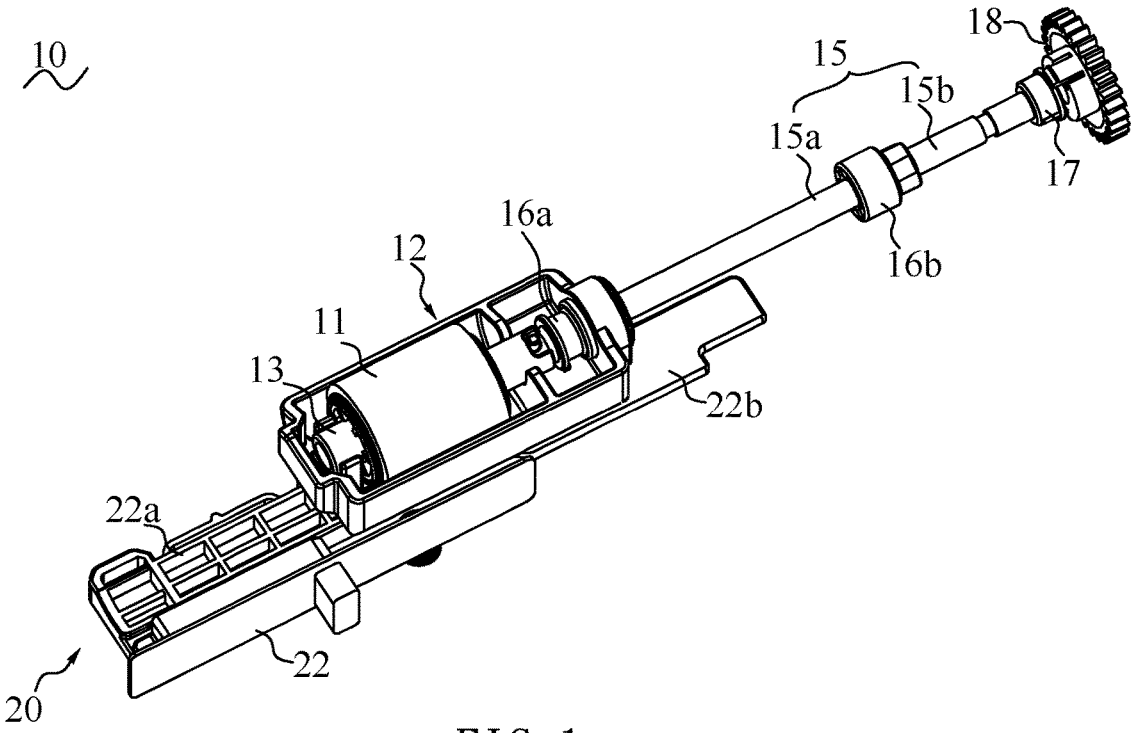
FIG. 1 is a perspective view of a paper pickup mechanism of a thick document conveying device in accordance with a first embodiment of the present invention.

With reference to FIG. 1 and FIG. 4-6, a thick document conveying device 100 in accordance with a preferred embodiment of the present invention is shown. The thick document conveying device 100 is used in an image forming apparatus such as a scanner and a printer. In the preferred embodiment, the thick document conveying device 100 includes a paper pickup mechanism 10. The paper pickup mechanism 10 has a pick roller 11, a pick roller base 12, a driving mechanism 15 and a gear 18. The driving mechanism 15 includes a first driving mechanism 15*a* and a second driving mechanism 15*b*. One end of the second driving mechanism 15*b* is sleeved on a bearing 17. The bearing 17 is connected to the gear 18. The other end of the second driving mechanism 15*b* is sleeved on one end of a second universal coupling 16*b*. The other end of the second universal coupling 16*b* is connected to one end of the first driving mechanism 15*a*. The other end of the first driving mechanism 15*a* is sleeved on one end of a first universal coupling 16*a*. The other end of the first universal coupling 16*a* is connected to a pick roller axle 13. The pick roller axle 13 is located in the pick roller base 12. The pick roller 11 is sleeved on the pick roller axle 13. The pick roller 11 is located in the pick roller base 12. A switching assembly 20 is located under the pick roller base 12. The pick roller base 12 is drove by the switching assembly 20 to move up toward A direction or move down toward C direction.

Figure 2:
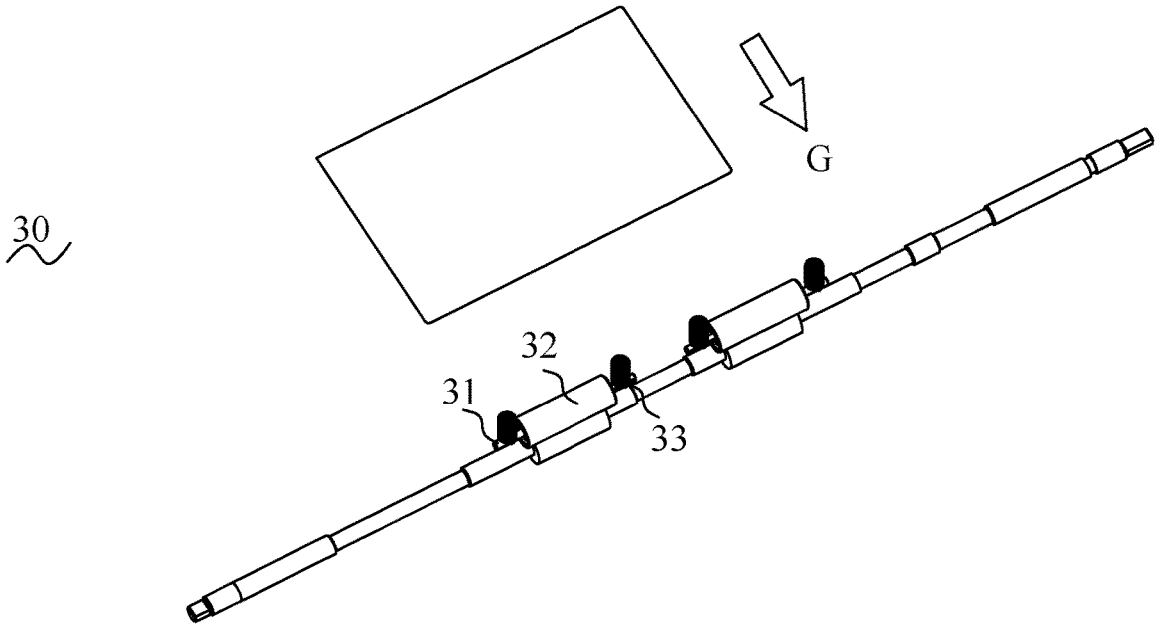
FIG. 2 is a perspective view of a feed roller mechanism of the thick document conveying device in accordance with a preferred embodiment of the present invention.
Figure 4:
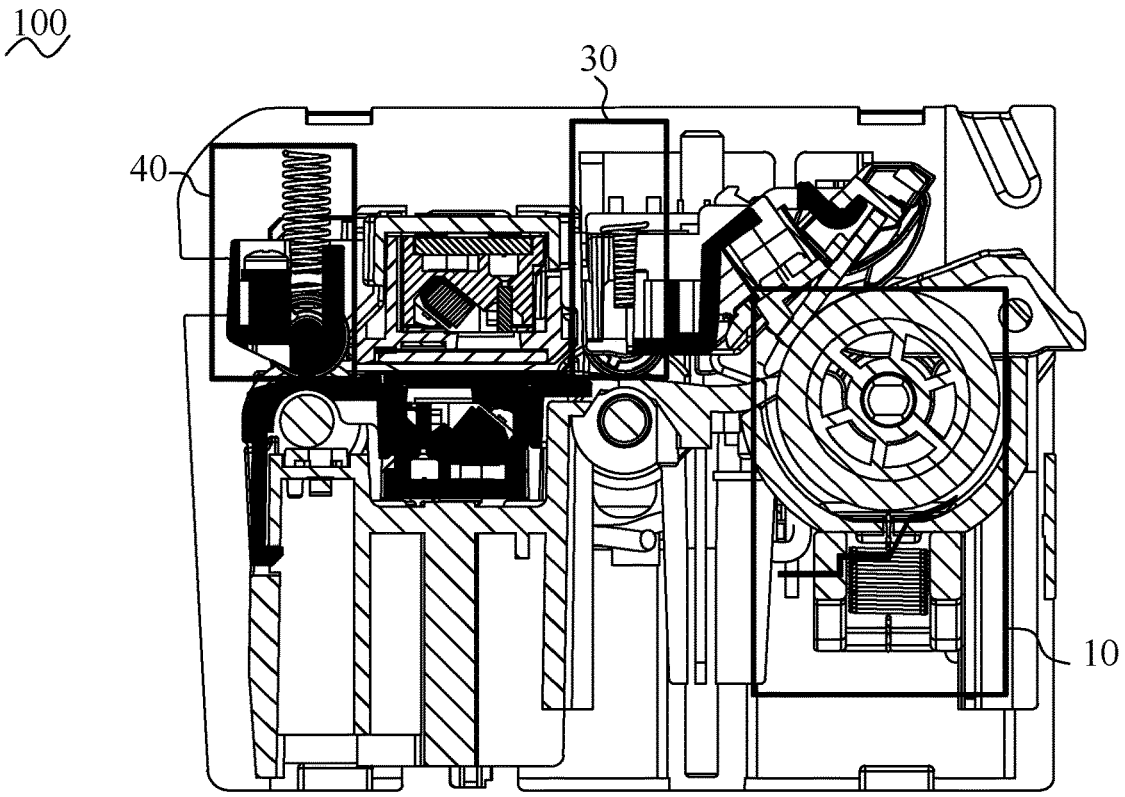
FIG. 4 is a section view of the thick document conveying device in accordance with the first embodiment of the present invention.

With reference to FIG. 2 and FIG. 4, the thick document conveying device 100 further comprises a feed roller mechanism 30 which cooperates with the paper pickup mechanism 10. The feed roller mechanism 30 includes a pick roller axle 31 and an idle pick roller 32. The idle pick roller 32 is sleeved on the pick roller axle 31. The pick roller axle 31 is connected to a bracket of the image forming apparatus (not shown) by at least two second springs 33 for ensuring that the idle pick roller 32 is pushed by a thick document to move upward when the thick document is conveyed into a document channel of the thick document conveying device 100.

Figure 3:
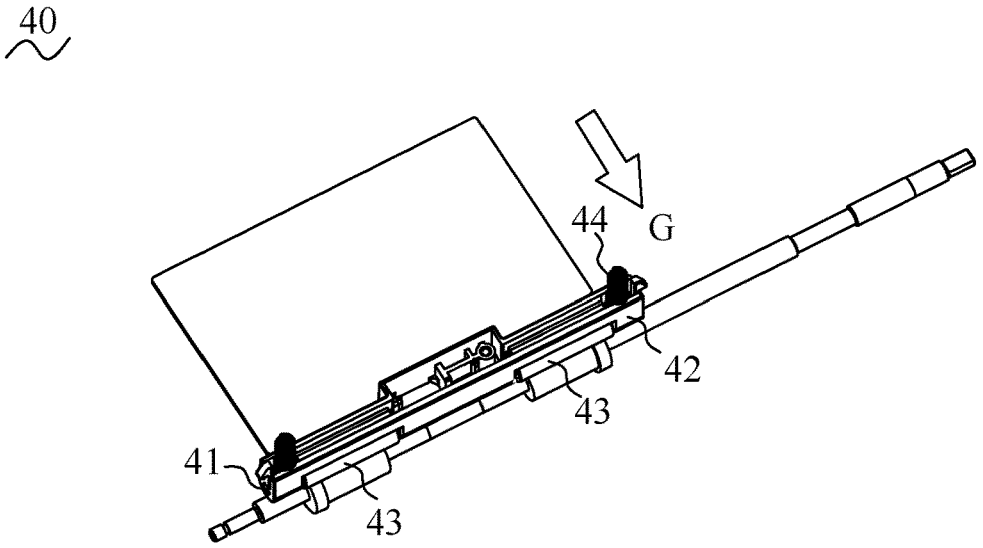
FIG. 3 is a perspective view of a discharge roller mechanism of the thick document conveying device in accordance with the preferred embodiment of the present invention.

With reference to FIG. 3 and FIG. 4, the thick document conveying device 100 further comprises a discharge roller mechanism 40. The discharge roller mechanism 40 includes an discharge roller base 42 and an idle discharge roller 43. The idle discharge roller 43 is sleeved on a discharge roller axle 41. The idle discharge roller 43 is located under the discharge roller base 42. At least two third springs 44 are mounted on an upper surface of the discharge roller base 42. The discharge roller base 42 is connected to a cover of the image forming apparatus (not shown) by the third springs 44 for ensuring that the discharge roller base 42 is pushed by the thick document to move upward when the thick document is discharged from the document channel of the thick document conveying device 100.

With reference to FIG. 3-6, the paper pickup mechanism 10 is located under the document channel and is located at an upstream direction of the document channel. The discharge roller mechanism 40 is located above the document channel and is located at a downstream direction of the document channel. The feed roller mechanism 30 is located above the document channel and is located between the paper pickup mechanism 10 and the discharge roller mechanism 40. In used status, a height of the pick roller base 12 is adjusted by the switching assembly 20, so that a height of the pick roller 11 can be adjusted. The pick roller base 12 can move up toward A direction or move down toward C direction by the switching assembly 20 described in the following embodiments, but is not limited to the embodiments.

With reference to FIG. 1, FIG. 5-6 and FIG. 22, in a first embodiment of the present invention, the switching assembly 20 includes a first spring 21 and a switch 22. The switch 22 is located below the pick roller base 12. A protrusion 14 is extended from a bottom surface of the pick roller base 12. The switch 22 includes an engaged protrusion 22*a*, an engaged recess 22*b* and a slope 22*c* between the engaged protrusion 22*a* and the engaged recess 22*b*. The engaged protrusion 22*a* is connected to a higher end of the slope 22*c*. The engaged recess 22*b* is connected to a lower end of the slope 22*c*. So that the switch 22 is step shape. The switch 22 has an open 22*d* extended from the engaged protrusion 22*a*, extended through the slope 22*c* and extended to the engaged recess 22*b*. The open 22*d* is penetrated the engaged protrusion 22*a*, the slope 22*c* and the engaged recess 22*b* along A-C direction. One end of the first spring 21 is connected to a bottom surface of the protrusion 14. The other end of the first spring 21 is passed through the open 22*d* and connected to the switch 22.

Figure 5:
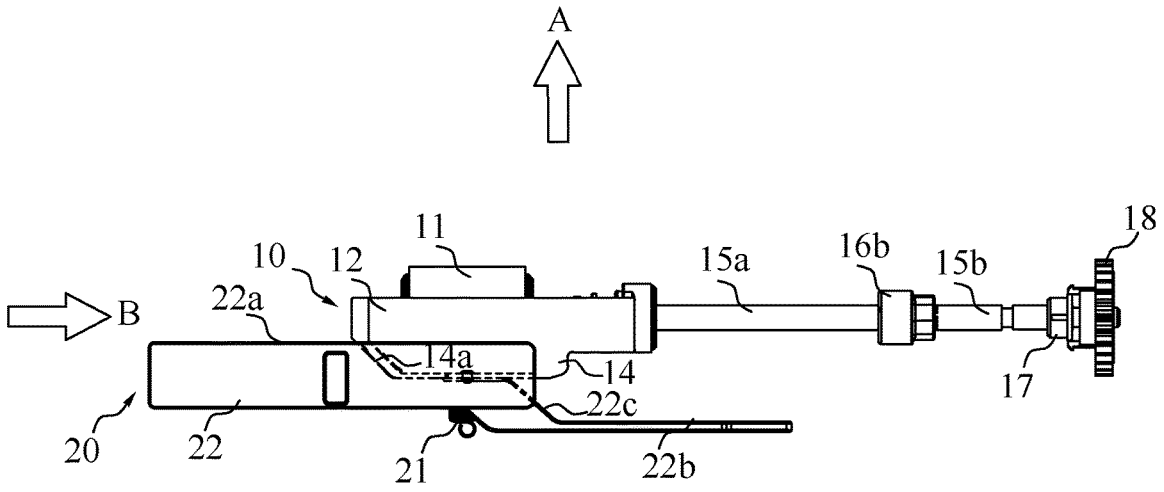
FIG. 5 is a perspective view showing a lifted status of a pick roller of the thick document conveying device in accordance with the first embodiment of the present invention.
Figure 6:
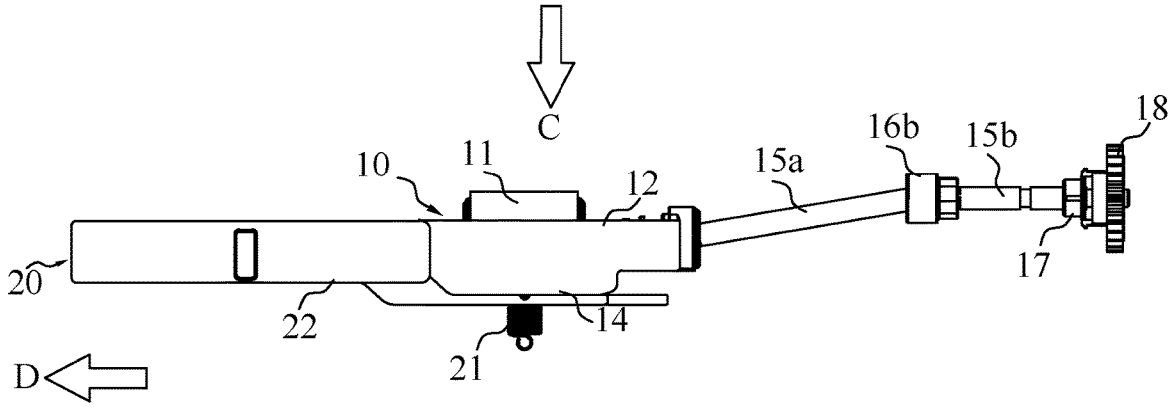
FIG. 6 is a perspective view showing a descended status of the pick roller of the thick document conveying device in accordance with the first embodiment of the present invention.
Figure 22:
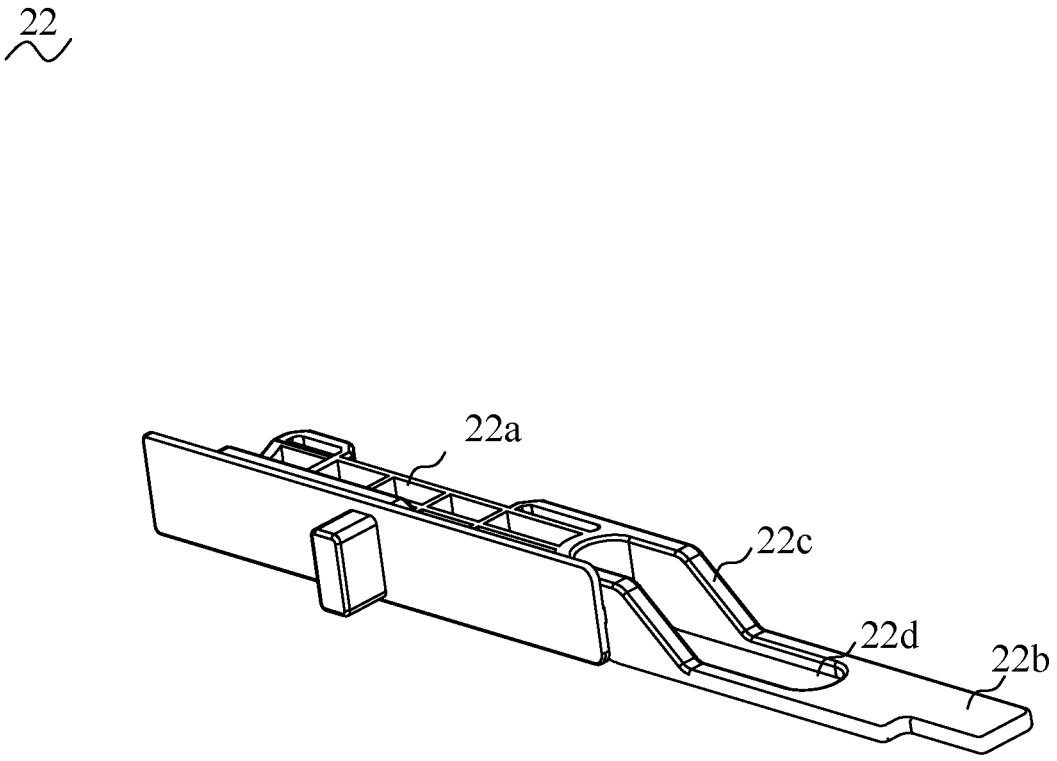
FIG. 22 is a perspective view of a switch of the paper pickup mechanism of the thick document conveying device in accordance with the first embodiment of the present invention.

With reference to FIG. 5-6 and FIG. 22, a wedge shape surface 14*a* is formed on the protrusion 14. The wedge shape surface 14*a* is fitted with the slope 22*c*, so that the pick roller base 12 is moved up toward A direction because the wedge shape surface 14*a* slides from the engaged protrusion 22*a*, slides through the slop 22*c* and slides to the engaged recess 22*b*, or the pick roller base 12 is moved down toward C direction because the wedge shape surface 14*a* slides from the engaged recess 22*b*, slides through the slop 22*c* and slides to the engaged protrusion 22*a*. The spring 21 is stretched in the open 22*c*. The spring 21 improves an engaged stability between the pick roller base 12 and an upper surface of the switch 22 when the pick roller base 12 is moved down toward C direction.

With reference to FIG. 5-6, in the preferred embodiment, when the switch 22 is pushed toward B direction, the pick roller base 12 is located on the engaged protrusion 22*a*, and the pick roller 11 is moved up toward A direction. When the switch 22 is pushed to D direction, the pick roller base 12 is moved down toward C direction, the wedge shape side 14*a* of the pick roller base 12 slides from the higher end of the slop 22*c* to the lower end of the slop 22*c*, so that the pick roller base 12 is located on the engaged recess 22*b*. Therefore the pick roller 11 is moved down toward C direction to effectively change the height of the pick roller 11 for both the thick document and the thin document.

Figure 7:
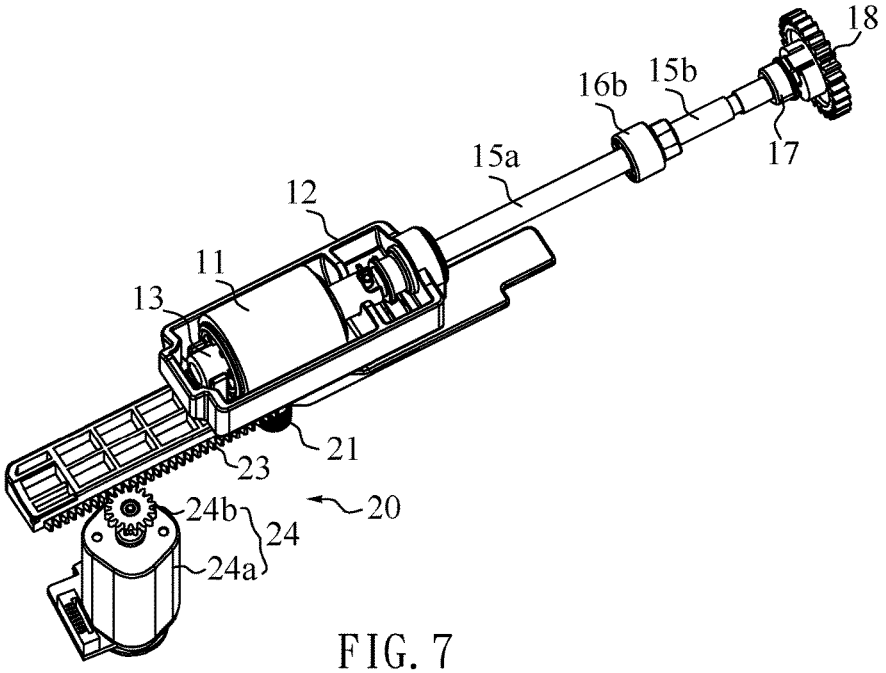
FIG. 7 is a perspective view of a paper pickup mechanism of the thick document conveying device in accordance with a second embodiment of the present invention.

With reference to FIG. 7, in a second embodiment of the present invention, the switching assembly 20 further includes a first switch driving component 24. The switch 22 is located below the pick roller base 12. A gear rack 23 is extended on a lateral surface of the switch 22. The gear rack 23 is extended on a long lateral surface of the switch 22. The gear rack 23 is extended along a transverse direction of the document channel. The gear rack 23 is extended along B-D direction. The first switch driving component 24 includes a driving motor 24*a* and a driving gear 24*b*. After the driving gear 24*b* is meshed with the gear rack 23, the switch 22 is moved toward B direction or D direction by the driving motor 24*a*.

Figure 8:
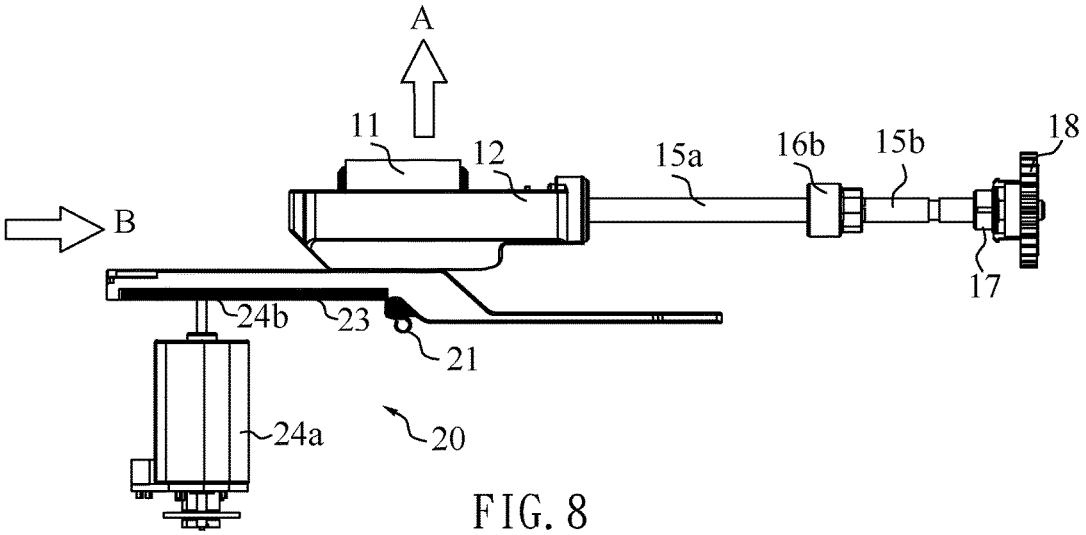
FIG. 8 is a perspective view showing a lifted status of a pick roller of the thick document conveying device in accordance with the second embodiment of the present invention.
Figure 9:
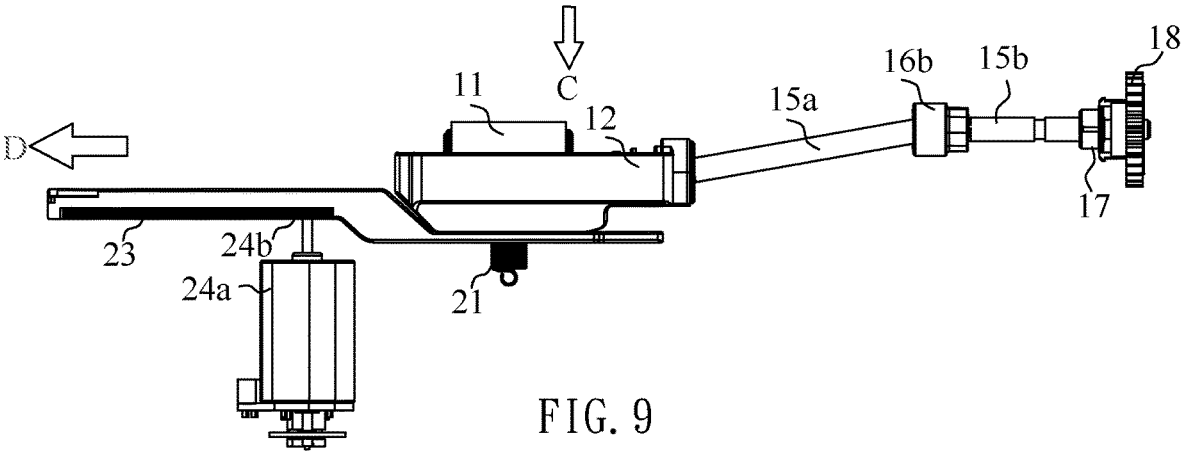
FIG. 9 is a perspective view showing a descended status of the pick roller of the thick document conveying device in accordance with the second embodiment of the present invention.

With reference to FIG. 8, in the preferred embodiment, when the driving motor 24*a* drives the gear rack 23 to move the switch 22 toward B direction, the pick roller 11 and the pick roller base 12 are moved up toward A direction. With reference to FIG. 9, when the driving motor 24*a* drives the gear rack 23 to move the switch 22 toward D direction, the pick roller 11 and the pick roller base 12 are moved down toward C direction to change the height of the pick roller 11.

Figure 10:
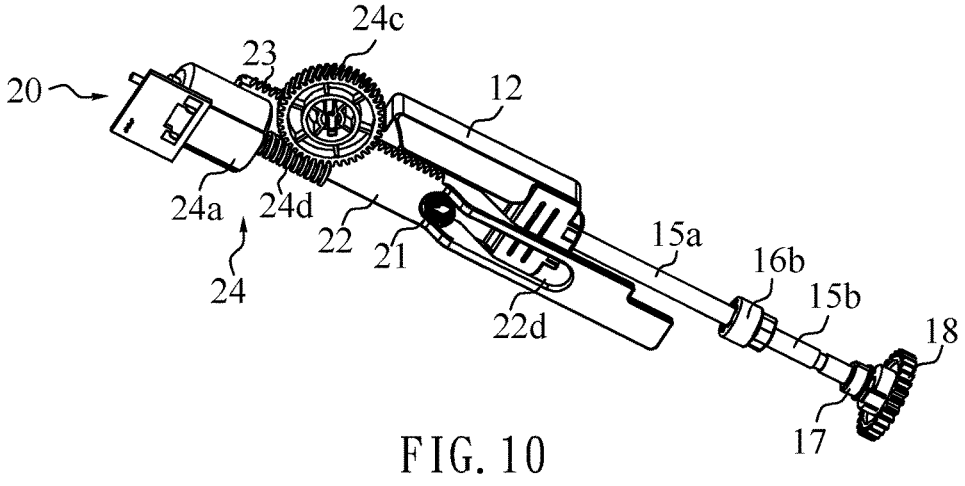
FIG. 10 is a perspective view of a paper pickup mechanism of the thick document conveying device in accordance with a third embodiment of the present invention.

With reference to FIG. 10, in a third embodiment of the present invention, the first switch driving component 24 further includes a worm gear 24*c* and a worm 24*d* meshed with the worm gear 24*c*. The driving gear 24*b* is replaced by the worm 24*d*. One end of the worm gear 24*c* is meshed with the gear rack 23, and the other end of the worm gear 24*c* is meshed with the worm 24*d*. The driving motor 24*a* is connected to the worm 24*d*. The worm gear 24*c* is driven by the worm 24*d* of the driving motor 24*a*, so that the switch 22 is moved along B-D direction.

Figure 11:
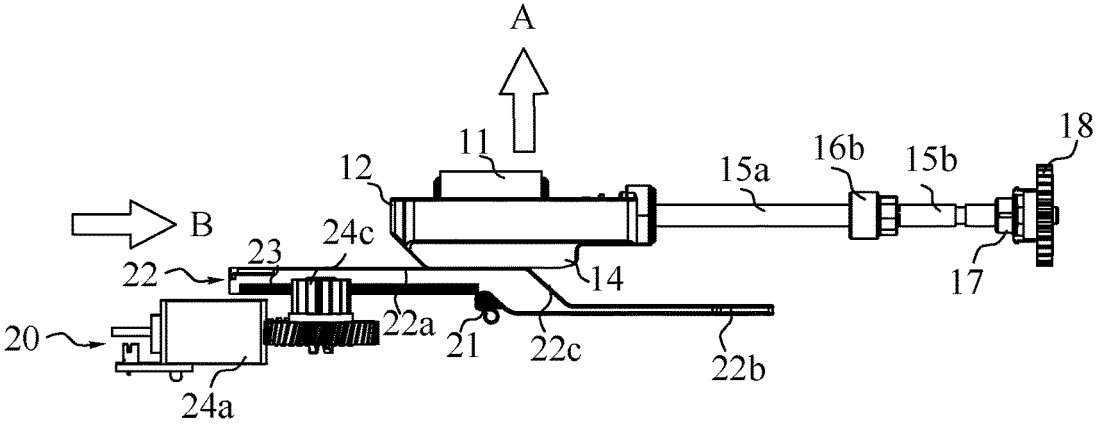
FIG. 11 is a perspective view showing a lifted of a pick roller of the thick document conveying device in accordance with the third embodiment of the present invention.
Figure 12:
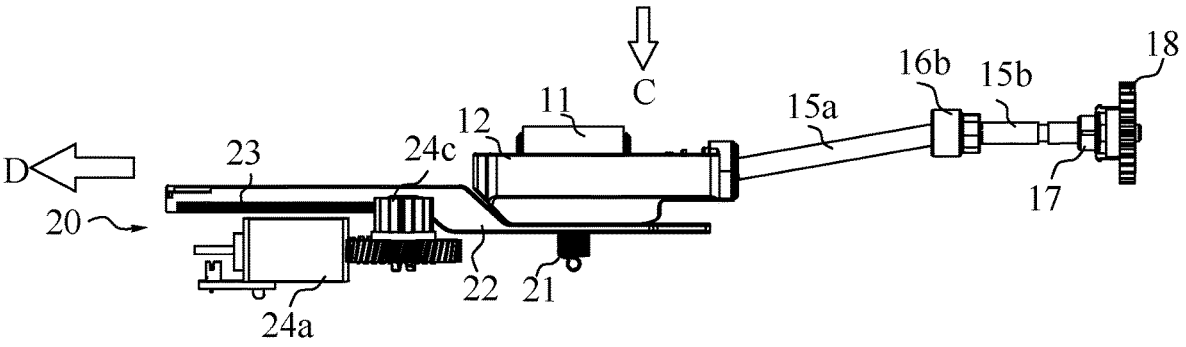
FIG. 12 is a perspective view showing a descended status of the pick roller of the thick document conveying device in accordance with the third embodiment of the present invention.

With reference to FIG. 11, in the preferred embodiment, when the driving motor 24*a* rotates clockwise, the switch 22 with the gear rack 23 is drove to move toward B direction, the pick roller base 12 and the pick roller 11 are moved up toward A direction. With reference to FIG. 12, when the driving motor 24*a* rotates counterclockwise, the switch 22 with the gear rack 23 is drove to move toward D direction, the pick roller 11 and the pick roller base 12 are moved down toward C direction to change the height of the pick roller 11.

Figure 13:
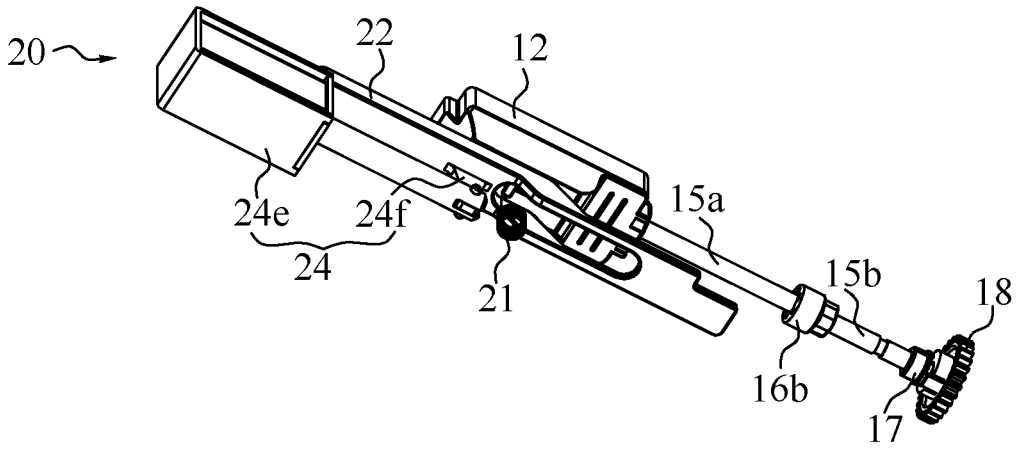
FIG. 13 is a perspective view of a paper pickup mechanism of the thick document conveying device in accordance with a forth embodiment of the present invention.

With reference to FIG. 13, in a forth embodiment of the present invention, the switching assembly 20 the switching assembly 20 includes a second switch driving component 24'. The first switch driving component 24 is replaced by the second switch driving component 24'. The second switch driving component 24' includes a straight electric cylinder 24*e* and a sliding block 24*f*. Two sides of the sliding block 24*f* are respectively connected to the electric cylinder 24*e* and a bottom surface of the switch 22, and the electric cylinder 24*e* drives the sliding block 24*f* to move the switch 22 with the sliding block 24*f* along B-D direction.

Figure 14:
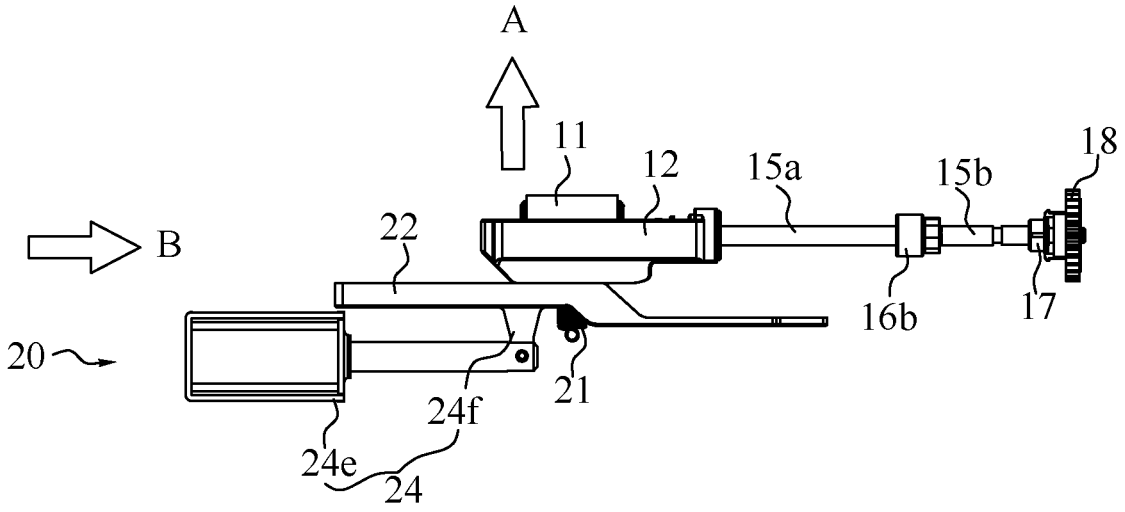
FIG. 14 is a perspective view showing a lifted status of a pick roller of the thick document conveying device in accordance with the forth embodiment of the present invention.
Figure 15:
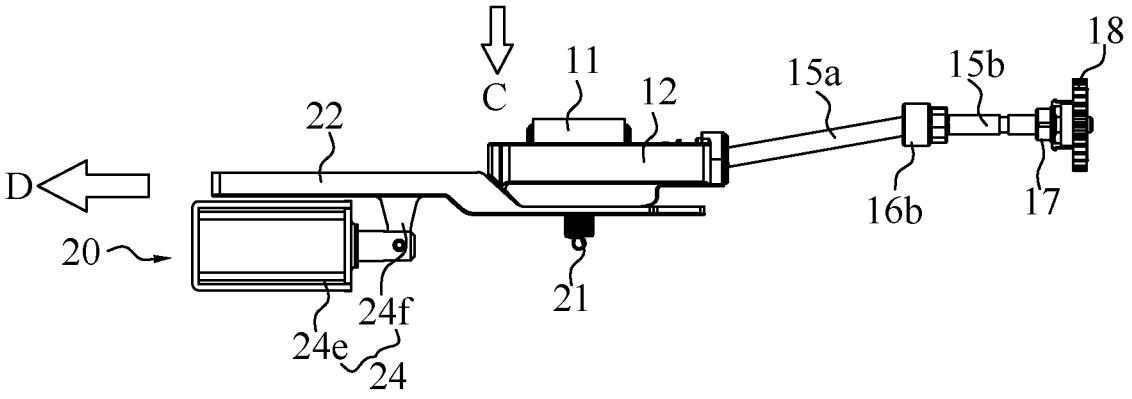
FIG. 15 is a perspective view showing a descended status of the pick roller of the thick document conveying device in accordance with the forth embodiment of the present invention.

With reference to FIG. 14, in the preferred embodiment, when the electric cylinder 24*e* pushes the sliding block 24*f* toward B direction, the pick roller base 12 is located on the engaged protrusion 22*a*, the pick roller 11 and the pick roller base 12 are moved up toward A direction. With reference to FIG. 15, when the electric cylinder 24*e* pulls the sliding block 24*f* toward D direction, the pick roller base 12 is located on the engaged recess 22*b*, the pick roller 11 and the pick roller base 12 are moved down toward C direction to change the height of the pick roller 11.

Figure 16:
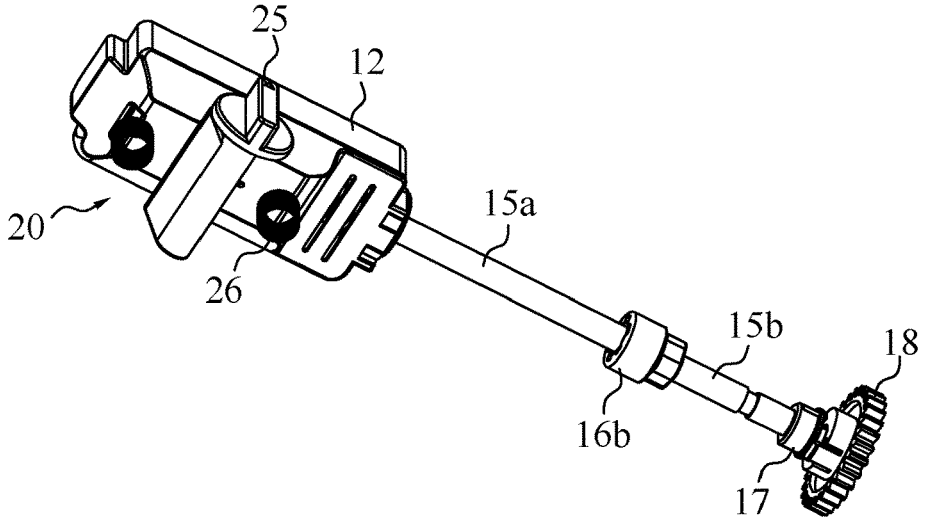
FIG. 16 is a perspective view of a paper pickup mechanism of the thick document conveying device in accordance with a fifth embodiment of the present invention.
Figure 17:
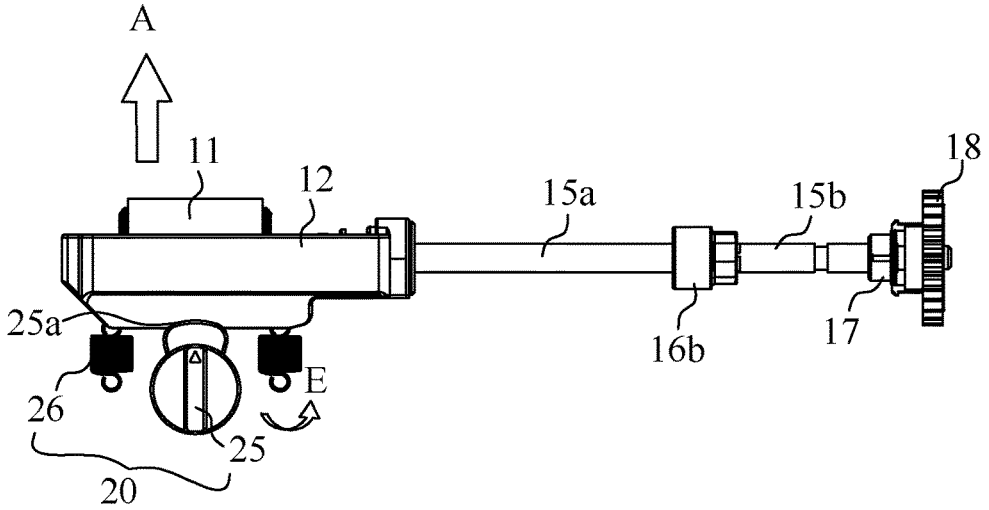
FIG. 17 is a perspective view showing a lifted status of a pick roller of the thick document conveying device in accordance with the fifth embodiment of the present invention.

With reference to FIG. 16 and FIG. 17, in the fifth embodiment of the present invention, the switching assembly 20 includes a button 25, a cam surface 25*a* and at least two restoring springs 26. The switch driving component is replace by the button 25, the cam surface 25*a* and the restoring springs 26. One end of each of the restoring springs 26 is fixed on the bottom surface of the pick roller base 12. The other end of each of the restoring springs 26 is connected to the bracket of the equipment. The button 25 is pivotally located on the bottom surface of the pick roller base 12. The cam surface 25*a* is formed on the button 25. The cam surface 25*a* is extended upward from the button 25 in a radial direction, the cam surface 25*a* is mated with the bottom surface of the pick roller base 12.

Figure 18:
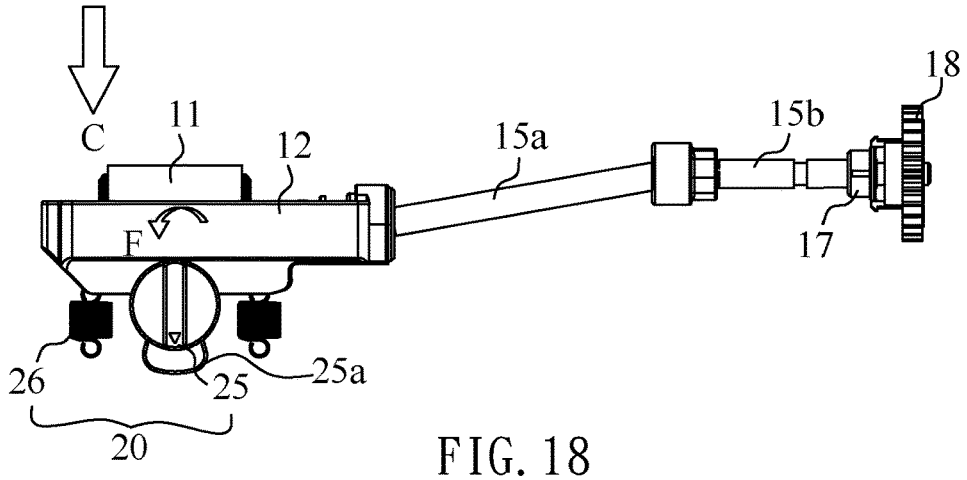
FIG. 18 is a perspective view showing a descended status of the pick roller of the thick document conveying device in accordance with the fifth embodiment of the present invention.

With reference to FIG. 17, in the preferred embodiment, when the button 25 is rotated toward E direction, the pick roller base 12 is putted up by the cam surface 25*a*, and the pick roller 11 is moved up toward A direction at the same time. With reference to FIG. 18, when the button 25 is rotated toward F direction, the cam surface 25*a* is away from the pick roller base 12, so that the pick roller base 12 and the pick roller 11 are moved down toward C direction.

Figure 19:
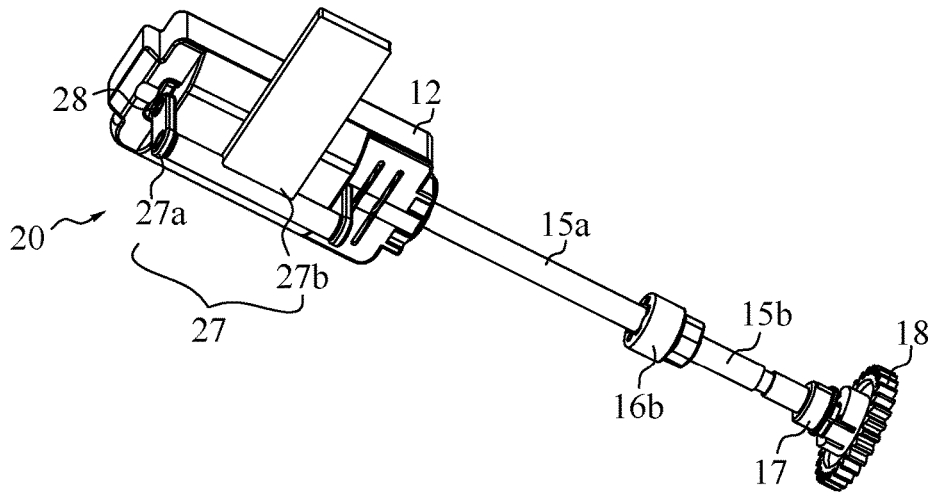
FIG. 19 is a perspective view of a paper pickup mechanism of the thick document conveying device in accordance with a sixth embodiment of the present invention.

With reference to FIG. 19, in the sixth embodiment of the present invention, the switching assembly 20 includes a swing mechanism 27. The switch driving component is replaced by the swing mechanism 27. The swing mechanism 27 includes a link rod 27*a*. An upper end of the link rod 27*a* is hinged on the bottom surface of the pick roller base 12 through a hinge axle 28. Therefore, the link rod 27*a* can be rotated around the hinge axle 28 to 90 degree. A connecting rod 27*b* is hinged on a lower end of the link rod 27*a*.

Figure 20:
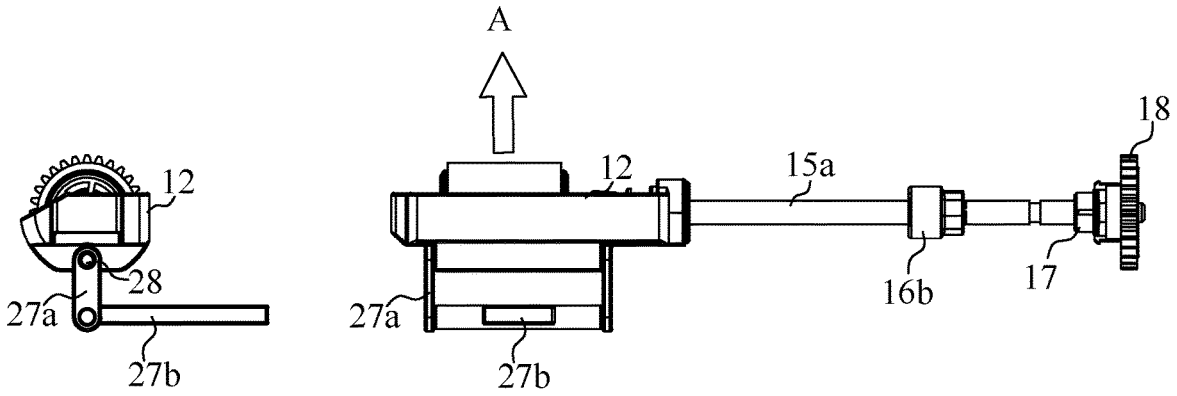
FIG. 20 is a perspective view showing a lifted status of a pick roller of the thick document conveying device in accordance with the sixth embodiment of the present invention.
Figure 21:
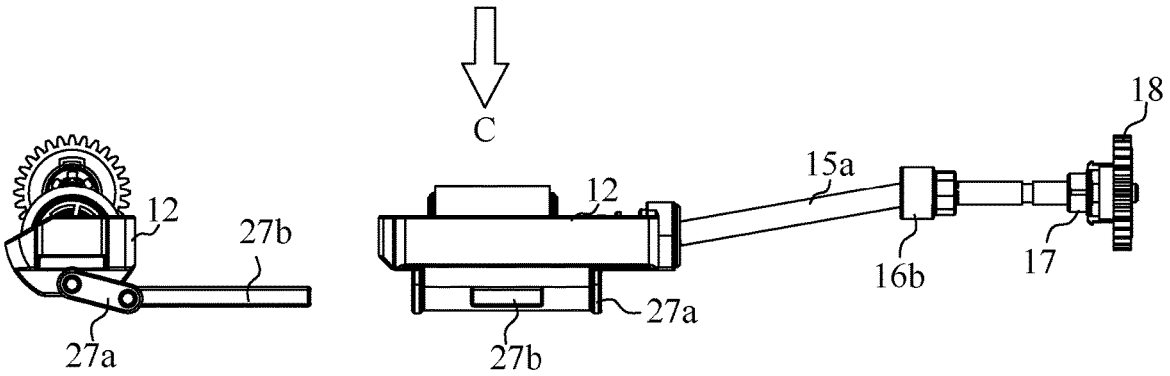
FIG. 21 is a perspective view showing a descended status of the pick roller of the thick document conveying device in accordance with the sixth embodiment of the present invention.

With reference to FIG. 20, in the preferred embodiment, when the connecting rod 27*b* is pushed toward the downstream direction of the document channel, the link rod 27*a* is pushed together with the connecting rod 27*b* to move toward the downstream direction of the document channel. The link rod 27*a* is moved from a horizontal position to a vertical position, so that the pick roller base 12 is pushed by the link rod 27*a* to move up toward A direction, and the pick roller 11 is moved up toward A direction at the same time. With reference to FIG. 21, when the connecting rod 27*b* is pulled toward the upstream direction of the document channel, the link rod 27*a* is pulled together with the connecting rod 27*b* to move toward the upstream direction. The link rod 27*a* is moved from the vertical position to the horizontal position, so that the pick roller base 12 is pulled by the link rod 27*a* to move down toward C direction, and the pick roller 11 is moved down toward C direction at the same time.

As described above, the thick document conveying device 100 can process both of the thick document and the thin document.

What is claimed is:

1. A thick document conveying device, comprising:

a paper pickup mechanism having a pick roller base, a pick roller axle being located in the pick roller base, a pick roller being located in the pick roller base and being sleeved on the pick roller axle, a switching assembly being located under the pick roller base, one end of a first universal coupling being connected to the pick roller axle, a driving mechanism having a first driving mechanism and a second driving mechanism, one end of the first driving mechanism being sleeved on the other end of the first universal coupling, one end of a second universal coupling being connected to the other end of the first driving mechanism, one end of the second driving mechanism being sleeved on the other end of the second universal coupling, a bearing being connected to the other end of the second driving mechanism; and a gear being connected to the bearing, wherein, in moved up status or moved down status, the pick roller base is drove by the switching assembly to move in a vertical direction.

2. The thick document conveying device as claimed in claim 1, wherein the switching assembly has a first spring and a switch, the switch is located below the pick roller base, a protrusion is extended from a bottom surface of the pick roller base, a wedge shape surface is formed on the protrusion, the switch has an engaged protrusion, an engaged recess and a slope between the engaged protrusion and the engaged recess, the engaged protrusion is connected to a higher end of the slope, the engaged recess is connected to a lower end of the slope, so that the switch is step shape, and the switch has an open extended from the engaged protrusion, extended through the slope and extended to the engaged recess, one end of the first spring is connected to a bottom surface of the protrusion, the other end of the first spring is passed through the open and connected to the switch, the wedge shape surface is fitted with the slope, so that the pick roller base is moved toward the engaged protrusion or moved toward the engaged recess.

3. The thick document conveying device as claimed in claim 1, wherein the switching assembly has a first spring, a switch and a switch driving component, the switch has an engaged protrusion, an engaged recess and a slope between the engaged protrusion and the engaged recess, a gear rack is extended on a lateral surface of the engaged protrusion, the gear rack is extended on a long lateral surface of the switch, the switch driving component has a driving motor and a driving gear connected to the driving motor, and the driving gear is meshed with the gear rack.

4. The thick document conveying device as claimed in claim 2, wherein the switching assembly has a switch driving component, a gear rack is extended on a lateral surface of the engaged protrusion, the gear rack is extended on a long lateral surface of the switch, the switch driving component has a driving motor and a driving gear connected to the driving motor, and the driving gear is meshed with the gear rack.

5. The thick document conveying device as claimed in claim 3, wherein the switch driving component has a worm gear and a worm meshed with the worm gear, one end of the worm gear is meshed with the gear rack, and the other end of the worm gear is meshed with the worm, the driving motor is connected to the worm.

6. The thick document conveying device as claimed in claim 4, wherein the switch driving component has a worm gear and a worm meshed with the worm gear, one end of the worm gear is meshed with the gear rack, and the other end of the worm gear is meshed with the worm, the driving motor is connected to the worm.

7. The thick document conveying device as claimed in claim 3, wherein the switch driving component has a straight electric cylinder and a sliding block, two sides of the sliding block are respectively connected to the straight electric cylinder and a bottom surface of the switch, and the straight electric cylinder drives the sliding block to move the switch with the sliding block along the long lateral surface of the switch.

8. The thick document conveying device as claimed in claim 4, wherein the switch driving component has a straight electric cylinder and a sliding block, two sides of the sliding block are respectively connected to the straight electric cylinder and a bottom surface of the switch, and the straight electric cylinder drives the sliding block to move the switch with the sliding block along the long lateral surface of the switch.

9. The thick document conveying device as claimed in claim 1, wherein the switching assembly has a button, a cam surface and at least two restoring springs, one end of each of the restoring springs is fixed on a bottom surface of the pick roller base, the other end of each of the restoring springs is connected to a bracket of an image forming apparatus, the button is pivotally located on the bottom surface of the pick roller base, the cam surface is formed on the button, and the cam surface is extended from the button in a radial direction, the cam surface is mated with the bottom surface of the pick roller base.

10. The thick document conveying device as claimed in claim 1, wherein the switching assembly has a swing mechanism, the swing mechanism has a link rod, an upper end of the link rod is hinged on a bottom surface of the pick roller base through a hinge axle, the link rod is rotated around the hinge axle to 90 degree, and a connecting rod is hinged on a lower end of the link rod.

11. The thick document conveying device as claimed in claim 1, further comprising a feed roller mechanism which cooperates with the paper pickup mechanism, the feed roller mechanism has a pick roller axle and an idle pick roller, the idle pick roller is sleeved on the pick roller axle, the pick roller axle is connected to a bracket of an image forming apparatus by at least two second springs for ensuring that the idle pick roller is pushed by a thick document to move upward when the thick document is conveyed into a document channel of the thick document conveying device.

12. The thick document conveying device as claimed in claim 1, further comprising a discharge roller mechanism, the discharge roller mechanism has an discharge roller base and an idle discharge roller, the idle discharge roller is sleeved on a discharge roller axle, and the idle discharge roller is located under the discharge roller base, at least two third springs are mounted on an upper surface of the discharge roller base, the discharge roller base is connected to a cover of an image forming apparatus by the third springs for ensuring that the discharge roller base is pushed by the thick document to move upward when the thick document is discharged from the document channel of the thick document conveying device.

* * * * *